United States Patent [19]

Rogers, Jr. et al.

[11] 4,337,977

[45] Jul. 6, 1982

[54] THREE-WAY HANDLE-OPERATED WALL-AVOIDING RECLINER CHAIR

[75] Inventors: Walter C. Rogers, Jr., Denton; David S. Hoffman, High Point, both of N.C.

[73] Assignee: Royal Development Company, Inc., High Point, N.C.

[21] Appl. No.: 186,414

[22] Filed: Sep. 12, 1980

[51] Int. Cl.[3] ..... A47C 1/02

[52] U.S. Cl. ..... 297/85; 297/322

[58] Field of Search ..... 297/85, 84, 271, 88, 297/89, 83, 86, 87, 322

[56] References Cited

U.S. PATENT DOCUMENTS

| | | | |
|---|---|---|---|
| 4,071,275 | 1/1978 | Rogers, Jr. | 297/85 |
| 4,108,491 | 8/1978 | Rogers, Jr. | 297/85 |
| 4,185,869 | 1/1980 | Rogers, Jr. | 297/84 |
| 4,226,469 | 10/1980 | Rogers, Jr. et al. | 297/322 |
| 4,249,772 | 2/1981 | Rogers, Jr. | 297/95 |

*Primary Examiner*—Francis K. Zugel

*Attorney, Agent, or Firm*—Cushman, Darby & Cushman

[57] ABSTRACT

A three-way, handle-operated, wall-avoiding, recliner chair with dual footrests. From closed position, the chair is operated to TV position by means of a handle connected to the footrest mechanism. The handle is also connected to a rear seat mounting link to move the seat forwardly to the base during which time a restraining mechanism prevents the backrest from moving relative to the seat. Once in the TV position, the restraining mechanism is no longer effective, and the occupant may exert pressure on the backrest to recline the seat further relative to the base while also moving the backrest forwardly relative to the seat as well as the base to avoid striking any nearby wall. Novel linkage mechanisms are provided for carrying out the above, and a spring mechanism is provided to lock the footrest closed against inadvertent actuation such as when the chair is being relocated and is being pulled by its armrests.

20 Claims, 9 Drawing Figures

134
79
78
76
66
77
73
72
50
65
67
42
10b
62
138
60
64
140
61
68
57
55
53
40
124
40b
108
10a
130
107
40a
101
105
100
44
109
104
10c
86
90
85
87
84
82
91
83
80
81
120
112
111
40
40b
110
130
105

THREE-WAY HANDLE-OPERATED WALL-AVOIDING RECLINER CHAIR

BACKGROUND OF INVENTION

The present invention relates to a three-way, wall-avoiding, recliner chair operated by means of a handle typically positioned on one side of the chair within easy grasp of the chair occupant. Three-way recliner chair is terminology used in the industry to describe a chair in which the backrest is movable relative to the seat at least during certain phases, and the seat is movable relative to the base and, of course, the footrest is movable relative to the seat. The use of the terminology "wall-avoiding" herein is meant to describe a recliner chair whose backrest will not strike a nearby wall when placed in reclining position by virtue of the fact that the seat to which the backrest is associated will move forwardly relative to the base when the chair is placed into reclining position. The terminology "handle-operated" recliner chair is used in the industry to denote a recliner chair whose footrest is actuated by means of a handle usually positioned on one side of the chair to be within easy reach of the chair occupant.

Three-way handle-operated, wall-avoiding recliner chairs are in the prior art such as disclosed in U.S. Pat. Nos. 4,071,275 and 4,108,491, the inventor therein being the same as one of the co-inventors in the subject application and the assignee being the same as the assignee of the subject application. One of the two chairs disclosed in the aforementioned patents, that in U.S. Pat. No. 4,108,491 is more pertinent to the chair of the present invention.

However, with the chair of U.S. Pat. No. 4,108,491, reduction of the height and width of the chair to compact the size for styling purposes, is limited by the linkage system of the chair. Also, portions of the linkage mechanisms must be accommodated in cavities formed in the armrests. Another shortcoming of the chair is that in the instance where it is being moved for relocation or other purposes and the armrests of the chair are grasped and pulled by the person moving the chair, the footrest is sometimes inadvertently actuated to its extended position which creates the obvious danger of suddenly striking the person moving the chair.

OBJECTS OF THE PRESENT INVENTION

It is a primary object of the present invention to provide novel and improved linkage mechanisms for a three-way, wall-avoiding, handle-operated, recliner chair.

It is a further object of the present invention to provide such novel and improved linkage mechanisms for a three-way, wall-avoiding, handle-operated, recliner chair allowing the chair to be designed with a very compact body for styling purposes. Included herein is the provision of such linkage mechanisms that may be placed substantially between the seat and base of the chair to further avoid the necessity of fabricating the armrests to accommodate portions of the linkage mechanisms.

A further object of the present invention is to provide such a three-way, wall-avoiding, handle-operated, recliner chair which has a bulit-in prevention against inadvertent actuation of the footrest such as when the chair is being moved for relocation or other purposes.

A still further object of the present invention is to provide such linkage mechanisms that will achieve the above objects and yet at the same time provide an extremely comfortable reclining chair of the type described, which moreover may be easily operated to its various positions.

SUMMARY OF INVENTION

A three-way, wall-avoiding, recliner chair actuated to TV position by a handle mechanism which is connected to a transmission link which transmits drive to the footrest linkage. The chair includes a unitary armrest and seat unit mounted to a base through means of front and rear seat mounting links. The transmission link is also connected to the rear seat mounting link to also initially move the chair forwardly relative to its base into a reclined TV position as the footrest is being extended.

In accordance with the invention, the transmission link is connected to the rear seat mounting link through a bell crank connected to the rear seat mounting link. The bell crank is also connected to a drive link from the backrest. In addition, another bell crank is provided, pivoted to the seat intermediate its ends with one end pivotally connected to the drive link by the same pivot which interconnects the drive link to the first bell crank. The other end of the second bell crank is connected to a pitch control link to transmit drive to the front seat mounting link for placing the seat into advanced reclining positions beyond TV position when the chair occupant exerts pressure on the backrest causing the drive link to actuate the bell cranks simultaneously as a unit. However, prior to the TV position when the chair is "closed" or in normal generally upright position, the backrest is restrained from moving relative to the seat by means including a restraining link interconnected between the seat and the transmission link. Also at this mode, the pivotal connection of the first bell crank link to the transmission link is out of alignment with the pivotal mounting of the second bell crank link to the seat, thus further preventing actuation of the bell cranks by the drive link. However, once the chair is placed into TV position, the aforementioned pivotal connections become horizontally aligned to permit actuation by the drive link from the backrest for placing the chair into advanced reclining positions forwardly and upwardly relative to the base during which time the backrest also moves relative to the seat.

DRAWINGS

Other objects and advantages of the present invention will become apparent from the following more detailed description taken in conjunction with the drawings in which.

DETAILED DESCRIPTION

Figure 1B:
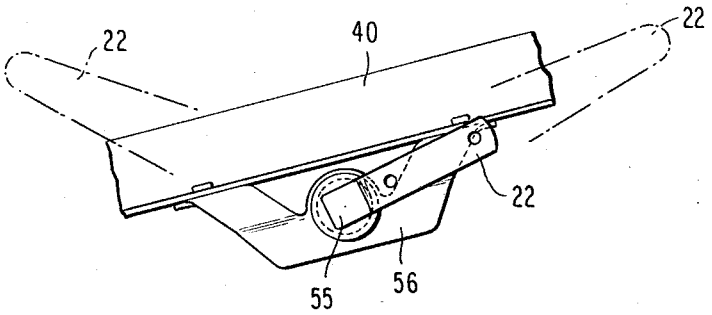
FIG. 1B is a side elevational view of a portion of the linkage system shown in FIG. 1A illustrating a bracket used for mounting a handle actuator.

Referring now to the drawings in detail, there is shown for illustrative purposes only, a three-way, handle-operated, wall-avoiding, recliner chair constituting a preferred embodiment of the present invention. Referring to FIG. 2C, the basic chair parts include a fixed base 10 which rests on the floor, a seat 12 mounted by a seat linkage system to be described, for movement to the base, a backrest 14 mounted relative to the seat for movement with the seat and for movement relative to the seat through means of a backrest linkage to be described; and a footrest including dual footrest supports 18 and 20, movable by a footrest mechanism to be described for movement between a retracted position shown in FIG. 1C and an extended position projected forwardly from the chair shown in FIG. 2C. Actuation of the footrest mechanism between the extended and retracted positions is achieved independently of the backrest through a manual control handle 22 mounted on one side of the chair as shown in FIG. 2A. The chair further includes armrests 24 fixed rigidly to the seat 12 to move together with the latter as a unit.

The linkage system of the chair parts described above includes two linkage mechanisms one on each side of the chair, one mechanism being a mirror image of the other except for the control handle 22 which is usually positioned on the right-hand side of the chair, that is, the side that would be on the right of the chair occupant. For the purposes of the present description, only one linkage mechanism need be described, and with reference to FIGS. 1A, 2A and 3A, there is shown one mechanism that is positioned on the right-hand side of the chair, that is, the side that will be positioned on the right of the chair occupant.

THE CHAIR FRAME

Figure 1A:
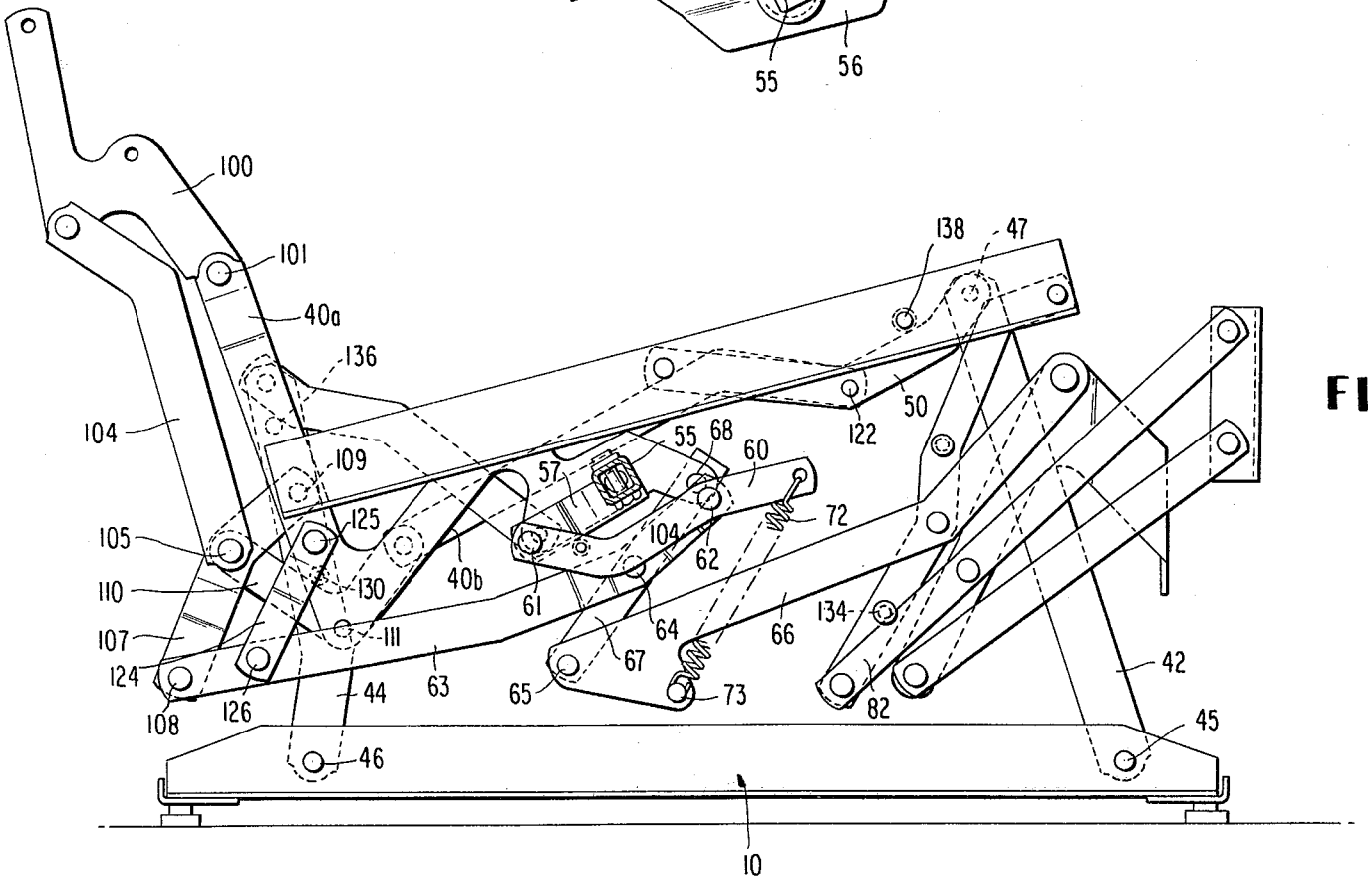
FIG. 1A is a side elevational view of a linkage system constituting a preferred embodiment of the invention for use in a three-way, wall-avoiding, recliner chair, the linkage system being shown in the closed or generally upright position with the footrest retracted and with certain parts removed from clarity.
Figure 1C:
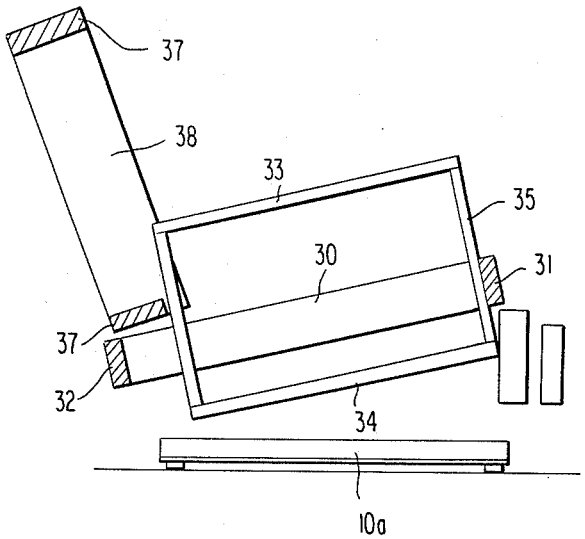
FIG. 1C is a side elevational view of a three-way, wall-avoiding recliner chair illustrated with its basic parts only and which may incorporate the linkage mechanism of the present invention, the chair being shown in the normal or generally upright position.
Figure 2C:
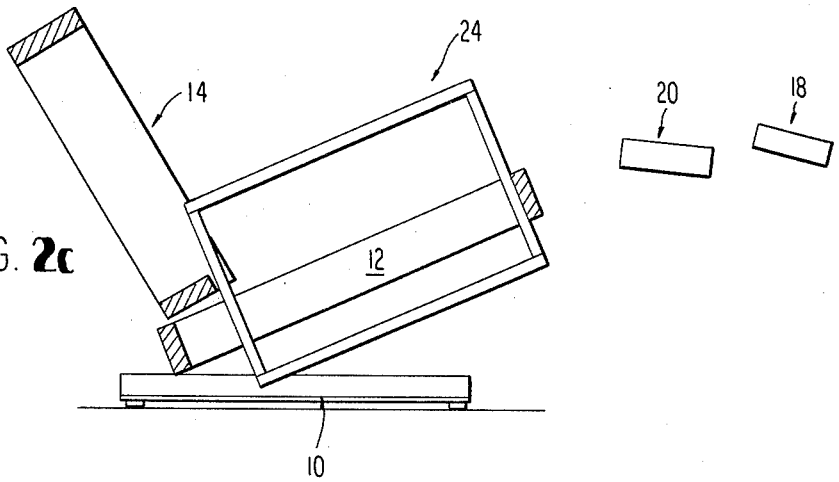
FIG. 2C is a view generally similar to FIG. 1C except that the chair parts are shown in TV position.
Figures 2A, 2B:
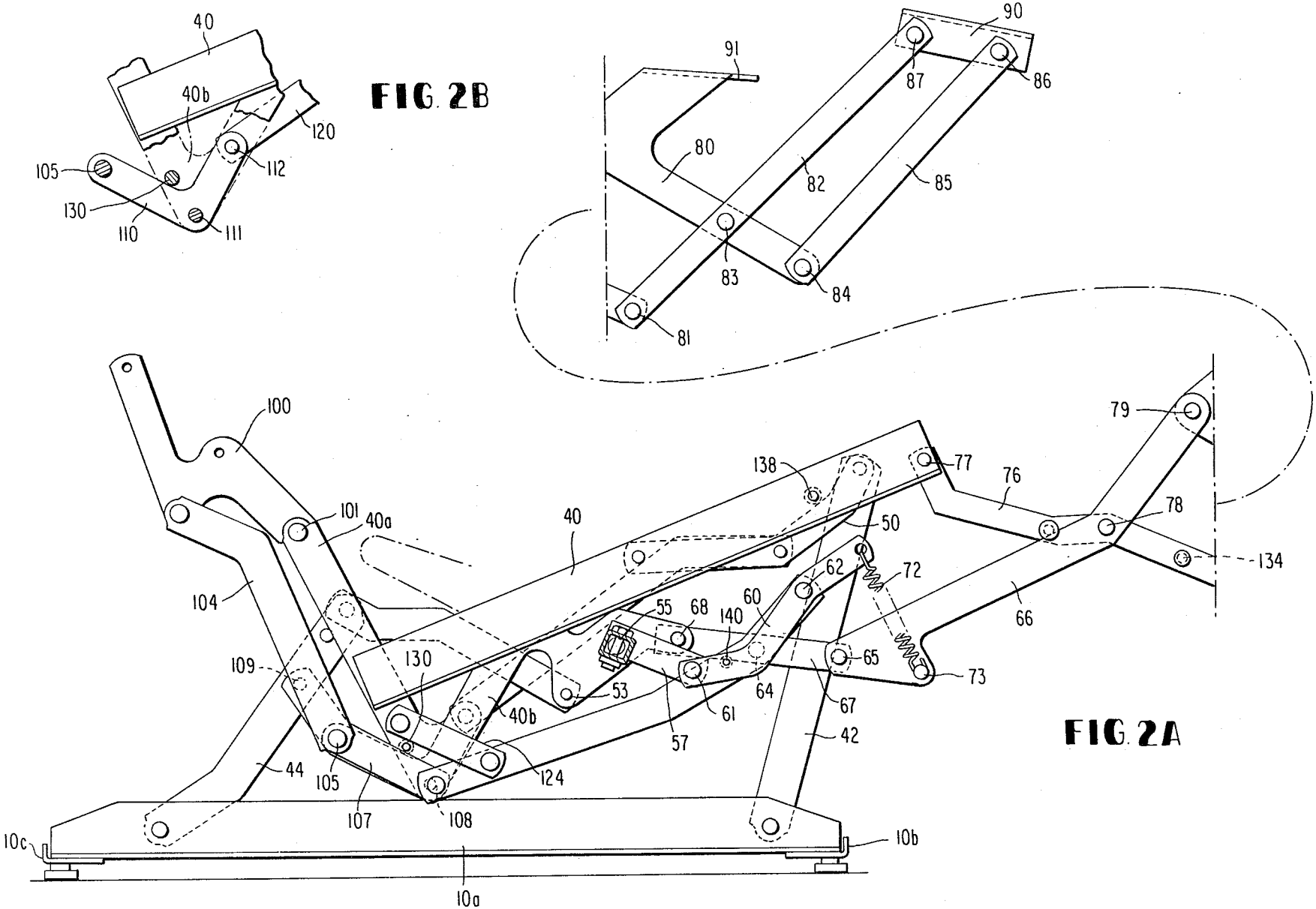
FIG. 2A is a view generally similar to FIG. 1A except that the linkage system is shown in the TV position, that is, with the footrest extended.
FIG. 2B is a fragmentary view of portions of the linkage system shown in FIG. 2A.

Referring to FIG. 1C, the frame of the chair seat includes side rails 30 interconnected by front and rear cross pieces 31 and 32 and being fixed to the armrest frame which includes an upper armrest rail 33 and a lower armrest rail 34 interconnected by front and rear vertical frame members 35 and 36 which are fixed to the seat frame. As will be described, the linkage mechanism at each side of the chair mounts the unitary seat and armrest frame relative to the base 10 which includes opposite side frame members 10*a* joined at the front and rear ends thereof by cross frame members 10*b* and 10*c* (see FIG. 2A). Although the base frame members may be made from any suitable material such as wood, they are shown as being made from steel angle members. The frame parts of the seat and armrests are shown as being made from wood, although any other suitable material may be employed. The frame of the backrest may also be made with a similar construction, that is, cross pieces 37 joined by vertical pieces 38 to form a generally rectangular configuration. Vertical pieces 38 are interconnected to the heat by means of linkage mechanisms to be described.

SEAT LINKAGE

The seat linkage in the preferred embodiment includes a seat link generally designated 40 which is elongated and extends in the forward-rearward direction of the chair where it is fixed to an associated side rail 30 of the seat frame to move with the seat frame and, of course, the armrests as a unitary part. Seat link 40 and in turn its associated seat, is mounted for reclining movement between a closed position shown in FIG. 1A and a plurality of reclined positions including TV position shown in FIG. 2A and fully reclined position shown in FIG. 3A, by means of front and rear seat mounting links 42 and 44, the bottom ends of which are pivotally mounted by pivot pins 45, 46 to the base. In the preferred embodiment, front seat mounting link 42 is pivotally connected at its upper end by pivot 47 through means of what will be termed "intermediate seat mounting link" 50 whose rear end is pivotally connected by pin 51 to the seat link 40. Additionally, in the preferred embodiment, rear seat mounting link 44 is pivotally connected at its upper end to what will be termed "intermediate seat mounting link" 52 whose lower end is pivotally connected by pivot pin 53 to seat link 40. It should be noted here that seat link 40 includes a vertical rear portion 40*a* extending above the main body portion of seat link 40; and a depending portion 40*b* below the main body portion thereof.

HANDLE-OPERATED ACTUATING MECHANISM

The prime actuating mechanism of the chair is derived through means of manual control handle 22 mounted on one side of the chair by fixation to a stub shaft 55 which, in turn, is mounted for rotation in a bracket 56 (FIG. 1B) fixed to seat link 40. Shaft 55 has fixed thereto on its inner end, a small crank 57 (see FIGS. 1A and 2A) to be rotatable with shaft 55 when the handle is rotated forwardly or rearwardly of the chair around the axis of the shaft. Crank 57 has its lower end pivotally connected by a pin 61 to a link 60 which extends generally forwardly of the chair from crank 57 and is movable forwardly or rearwardly of the chair by crank 57 depending on the direction of rotation of the handle. An intermediate location of link 60 is pivotally connected by pin 62 to what will be termed a "motion transmitting link" or "transmission link" 63 which extends rearwardly of link 60 where it is connected to other linkage parts to be described for transmitting motion to the rear seat mounting link 44 to move the seat forwardly when the footrest is actuated to extended position. Transmission link 63 also has an intermediate portion pivotally connected by pivot pin 64 to a footrest mounting and drive link 67 whose lower portion is pivoted by pivot pin 65 to a footrest link 66 which forms part of the footrest mechanism for driving the footrest mechanism to extended position. An upper end portion of footrest mounting link 67 is pivotally mounted by pivot pin 68 to the seat link portion 40*b*, however, footrest mounting link 67 also has an inwardly extending flange portion (not shown) which is fixed to a torque tube (not shown) for transmitting the movement of the footrest linkage mechanism on the right-hand side of the chair to the opposite side of the chair so that both linkage mechanisms will operate in unison when the handle is operated. It will thus be seen that link 60 deriving its force from the handle 22 and crank 57, drives the transmission link 63 which in turn, drives both the rear seat mounting link 44 and footrest drive link 67. Thus, link 60 may be termed a "main drive" link.

One of the features of the chair is a mechanism for biasing the footrest into the retracted position against inadvertent actuation to extended position such as when the chair is being moved for relocation or other purposes and the person moving the chair grasps the armrests of the chair and pulls the chair forwardly. This biasing mechanism in the preferred embodiment is an "overcenter" biasing mechanism including a tension spring 72 having one end anchored in an aperture formed at the forward end portion of link 60. The opposite end of tension spring 72 is anchored around a pin 73 fixed to footrest link 66 below link 60. Referring to FIG. 1A, when the chair is in the closed position, spring 72 will resist extension of the footrest to maintain the footrest in closed position against inadvertent actuation. However, when the handle is operated to project the footrest, the lower anchoring point 73 of spring 72 will move forwardly past the upper anchoring point to thus decrease tension on the spring facilitating actuation of the footrest to extended position. Spring 72 will then serve to resist retraction of the footrest until the lower anchoring point 73 of the spring moves rearwardly past the upper anchoring point.

FOOTREST LINKAGE

As described above, the footrest linkage includes a link 66 which mounts the footrest linkage relative to the seat through link 67 mounted to seat link portion **40*b*. It also includes another footrest mounting link 76 having its upper end pivotally connected by pin 77 to the forward end portion of seat link 40. Link 66 has an intermediate portion pivoted by pivot pin 78 to an intermediate portion of link 76 so that links 66 and 76 operate as scissors. The forward end portion of link 66 is pivoted by pin 79 to one end of a link 80 which extends generally parallel to link 76. The lower end of link 76 is pivotally connected by pin 81 to a link 82 whose intermediate portion is pivotally connected by pin 83 to link 80. The lower end of link 80 is pivotally connected by pin 84 to a link 85. Links 82 and 85 are generally parallel to each other and their forward ends are pivotally connected by pins 86 and 87 to a front footrest bracket 90 to which the front footrest upholstery frame is attached. The rear footrest upholstery frame is fixed to a bracket 91 preferably formed as an integral extension of link 80. It will be seen that in the retracted positions, the footrest brackets 90, 91** extend in generally vertical planes, one behind the other, and that in the extended positions, the footrest brackets extend at slight angles to the horizontal in different planes one behind the other.

BACKREST AND REMAINING LINKAGE

Figure 3C:
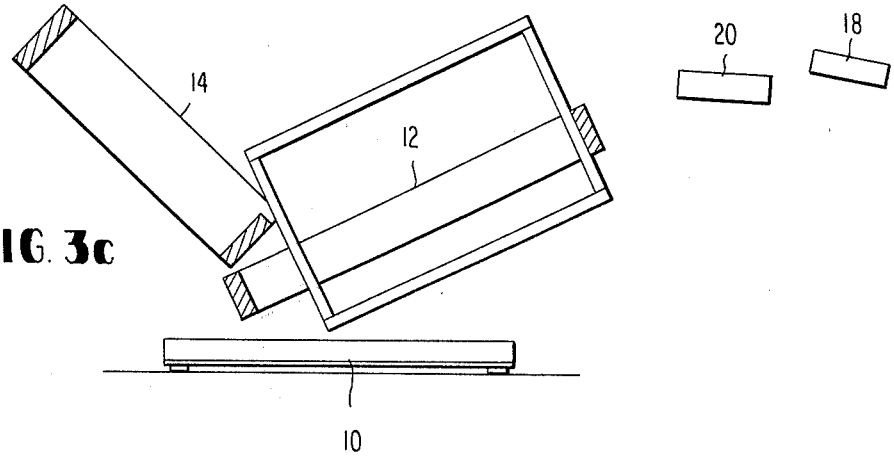
FIG. 3C is a view generally similar to FIG. 2C except that the chair parts are shown in the fully reclined position.
Figures 3A, 3B:
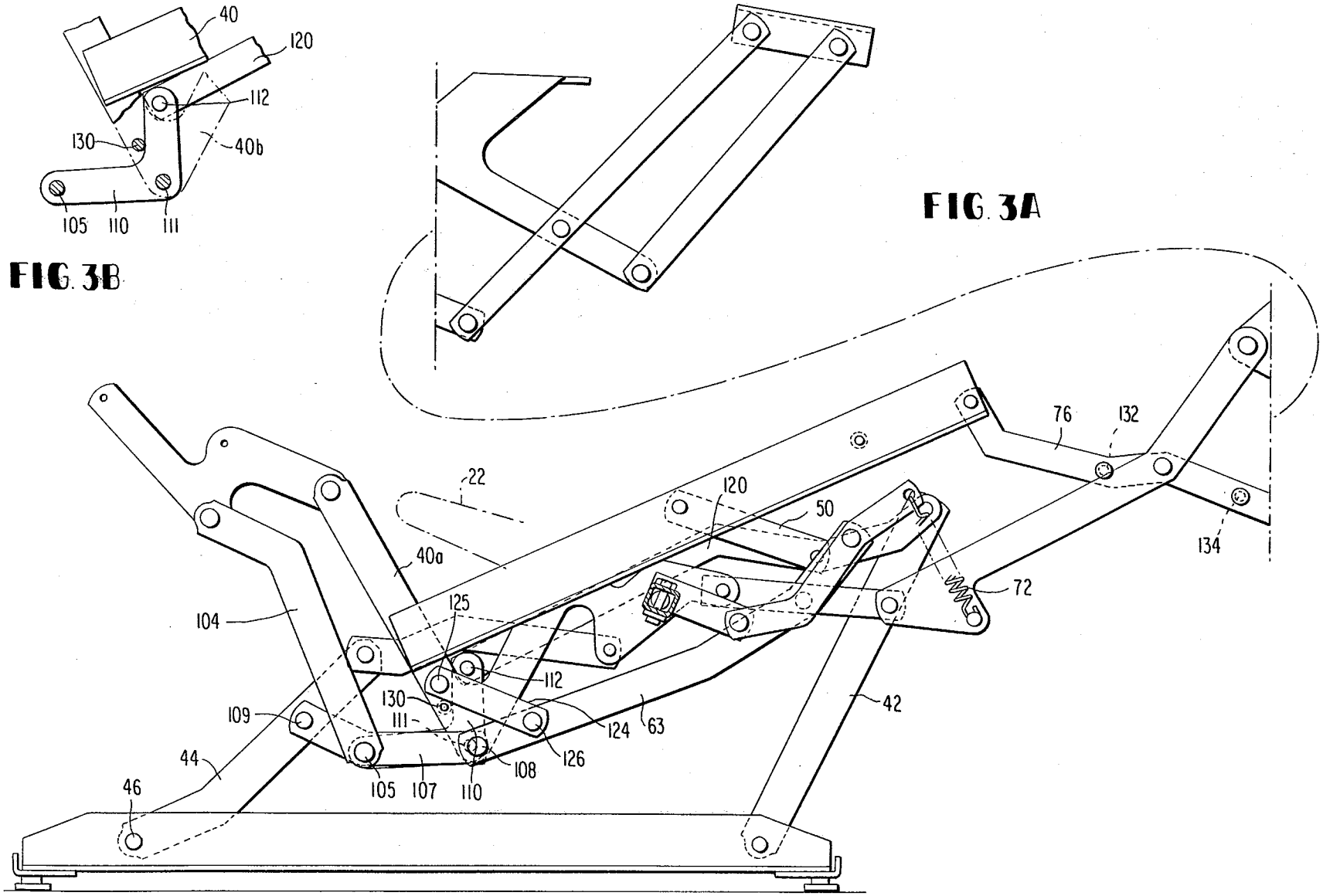
FIG. 3A is a view generally similar to FIG. 2A except that the linkage system is shown in the fully reclined position.
FIG. 3B is a view similar to FIG. 2B except showing the parts when the chair is in the fully reclined position of FIG. 3A.

Vertical frame 38 of the backrest has fixed thereto a backrest link 100 whose lower portion is pivoted by pin 101 to the upper end portion of the seat link rear portion **40*a*. Backrest link 100 has also pivoted thereto by pin 102, a generally vertical drive link 104 whose lower end is pivoted by pin 105 to a bell crank 107. The lower end of bell crank 107 is pivotally connected by pin 108 to the rear end of transmission link 63. The upper end portion of bell crank 107 is mounted by pivot pin 109 to an intermediate portion of rear seat mounting link 44. Pivot pin 105 used to interconnect links 104 and 107 is also utilized to mount another bell crank link 110 to the bell crank 107. Referring to FIGS. 3A and 3B, bell crank link 110 is pivoted by pin 111 to seat link portion 40*b*, while the forward end of bell crank link 110 is pivotally connected by pin 112 by an elongated pitch control link 120 which extends forwardly from the latter where it is pivotally connected at its forward end by pin 122 to an intermediate portion of intermediate seat mounting link 50. Pitch control link 120 also serves to actuate the seat relative to the base into advanced reclining positions, that is, reclining positions beyond TV position. This is achieved by virtue of the connection between link 120 and bell crank 110 and between 120 and intermediate seat mounting link 50. Through these connections, the force generated through bell crank 110 will cause the forward end of link 120 to swing downwardly in turn causing link 50** to swing upwardly in turn, causing the seat link to be placed into advanced reclining position.

In order to restrain the links 104 and 100 from moving relative to each other during the time the chair is moving from the closed to TV position, to prevent movement of the backrest relative to the seat, a small, restraining link 124 is provided which has its upper end pivotally connected by pin 125 to the seat link portion **40*b* and its lower end pivotally connected by pin 126 to the transmission link 63** forwardly of the rear end thereof.

In operation, when the handle is moved to project the footrest to the extended TV position, the forward swinging movement of footrest mounting and drive link 67 caused by link 60 in turn moved by crank 57 fastened to the handle shaft, will cause the transmission link 63 to move forwardly relative to the base. This will cause actuation of crank 107 at the rear of the chair to swing forwardly which, in turn, will actuate the rear seat mounting link 44 forwardly about its pivot 46 to the base causing the seat to be placed into a reclined position at a greater angle relative to the base while also causing the seat to be displaced forwardly relative to the base to achieve wall-avoiding action. During this latter movement, the restraining link 124 will prevent relative movement between links 104 and 100 to prevent movement of the backrest relative to the seat so that although the pitch or angle of the seat is increased when moving from the closed to the TV position, the angle (compare FIGS. 1C and 2C) between the backrest and the seat remains the same because of the action of restraining link 124. It should also be stated that after rear seat mounting link 44 is initially actuated through the handle mechanism and passes the vertical plane, the weight of the chair occupant will become effective to continue the forward swinging movement of link 44 to facilitate movement of the chair to TV position, the latter being shown in FIGS. 2A and 2C.

It should also be noted that in accordance with the invention, when the chair is in the TV position, the lower pivot 108 of bell crank 107 and the lower pivot 111 of the other bell crank 110 will become aligned generally one behind the other as shown in FIGS. 2A and 3A. Thus in order to go from TV position to an advanced reclining position, all the occupant need do is exert pressure on the backrest which will cause a force to be transmitted downwardly through link 104 through bell cranks 107 and 110 which will move together as one piece and as part as a four-bar linkage including those two elements (as one link) as well as links 104 and 100 and portion 40*a* of the seat link to allow the seat and backrest to move relative to each other in order to place the chair into advance reclining positions. During this latter movement, the movement of the seat and the angle of pitch of the seat will be controlled by elongated link 120 by virtue of its interconnection to bell crank 110 and intermediate seat mounting link 50 as described above. Also, during the latter movement, the weight of the occupant will cause the rear seat mounting link 44 to pivot further forwardly about its pivot 46 to the base to move the seat forwardly to obtain further wall-avoiding action of the backrest. The full reclining position is shown in FIGS. 3A and 3C where it may be seen that the backrest has moved rearwardly relative to the seat, and the seat has moved forwardly while swinging upwardly relative to the base. However, the footrests 18, 20 have kept their position relative to the seat.

It should also be noted that when the chair is in the generally upright or normal position, the pivots 108 and 111 of the bell cranks 107 and 110 respectively are out of alignment as shown in FIG. 1A so that any pressure extended on the backrest by the chair occupant will not be effective to recline the backrest relative to the seat unless the chair is first placed into TV position.

STOP MECHANISMS

In the full reclining position of FIG. 3A, a stop 130 fixed to seat link portion 40*b* engages bell crank 110 (also see FIG. 3B) to prevent further movement of the linkage. Also, a stop 132 on the footrest link 76 engages link 66 to positively limit further movement of the footrest linkage. In the closed or normal position of the chair shown in FIG. 1A, stop 130 engages another portion of crank 110 while another stop 134 on footrest link 76 engages footrest link 82. In addition, a stop 136 is provided on seat link portion 40*a* to engage intermediate seat mounting link 52; and a stop 138 is similarly provided on seat link 40 to engage intermediate seat mounting link 50. Note that when the chair moves to TV position shown in FIGS. 2A, 3B, stops 130 and 138 remained engaged because the backrest and seat move together as a unit into the TV position.

In the preferred embodiment, the handle actuating mechanism is provided with stops to provide positive positions for the handle actuating mechanism. To this end, a stop 140 is fixed to main drive link 60 to engage crank 57 when the chair is in the normal generally upright position, that is, when the linkage is closed, as shown in FIG. 1A. When the handle is pivoted to place the chair into TV position (FIG. 2A), stop 140 will engage footrest link 67 and will remain so engaged for all advanced reclining positions of the chair.

What is claimed is:

1. A three-way wall-avoiding, recliner chair comprising: a base, a seat and armrest unit including armrests fixed to the seat, a backrest mounted to and movable relative to the seat, a footrest including a footrest linkage mounted to the seat for movement between a retracted position adjacent the seat and an extended position projected forwardly from the seat, a handle-operated, actuating mechanism mounted to the seat for actuating the footrest linkage between extended and retracted positions, a linkage system mounting the seat and armrest unit to the base and mounting the backrest to the seat and armrest unit for movement between a normal generally upright position and a plurality of reclining positions, the linkage system comprising, front and rear seat mounting links (42, 44) pivoted to the base and pivotally connected relative to the seat, a first bell crank (107) pivotally connected to the rear seat mounting link, a drive link (104) having one end portion pivotally connected to the backrest and an opposite end position pivotally connected to said first bell crank link (107), a transmission link (63) connected between the handle mechanism and the first bell crank for transmitting a force to the rear seat mounting link (44) to move the seat forwardly relative to the base into a TV position when the footrest is initially actuated to extended position by means of the handle mechanism, a restraining link (124) pivotally connected to and between the seat and the transmission link for preventing movement of the drive link and the backrest relative to the seat during movement of the seat into TV position, a second bell crank (110) having one end portion pivotally connected to the drive link at the same pivotal connection of the first bell crank to the drive link, said second bell crank having an intermediate portion pivotally mounted to the seat such that the pivotal connection of the first bell crank to the transmission link is aligned with the pivotal connection of the second bell crank to the seat when the seat is in the TV position permitting the backrest to be moved relative to the seat and the seat to be reclined further relative to the base upon application of pressure on the backrest by the chair occupant causing a drive force to be transmitted downwardly from the backrest through the drive link (104) to the bell crank link, and a pitch control link (120) pivotally connected to an end portion of the second bell crank (110) opposite the first end portion thereof and pivotally connected relative to the seat for transmitting actuating forces to the seat and for controlling the pitch of the seat when moving into reclining positions beyond TV position.

2. The chair defined in claim 1 wherein the linkage system further includes a first intermediate seat mounting link (50) having one end portion pivotally connected to the seat and an opposite end portion pivotally connected to the front seat mounting link (42) and having an intermediate portion pivotally connected to said opposite end portion of the pitch control link, and a second intermediate seat mounting link (52) pivotally interconnected to and between the seat and the rear seat mounting link (44).

3. The chair defined in claim 1 wherein said handle-operated actuating mechanism includes a handle mounted to the seat for rotational movement, a crank (57) fixed to the handle to be rotatable therewith, a main drive link (60) pivotally interconnected to and between the last-defined crank (57) and said transmission link (63) for driving the latter.

4. The chair defined in claim 3 wherein said transmission link (63) is also pivotally connected to the footrest linkage to drive the same between the extended and retracted positions upon rotation of the handle.

5. The chair defined in claim 4 wherein said footrest linkage includes a mounting and drive link (67), and said transmission link is connected to said footrest mounting and drive link (67).

6. The chair defined in claim 5 wherein said footrest linkage further includes a pair of scissor links (66, 76), one (76) being pivotally connected to the seat and the other (66), pivotally connected to said footrest mounting and drive link (67) and wherein there is further included a spring mechanism including a tension spring (72) having one end fixed relative to the scissor link that is connected to the footrest mounting link for biasing the footrest into retracted position.

7. The chair defined in claim 6 wherein the other end of the tension spring is fixed to the main drive link (60) such that in the retracted position of the footrest, the point of fixation of the spring to the associated scissor link is positioned rearwardly of the point of fixation of the spring to the main drive link 60, and in the extended position of the footrest the point of fixation of the spring to the associated scissor link is positioned forwardly of the point of fixation of the spring to the main drive link such that the spring also biases the footrest linkage to remain in the extended position.

8. The chair defined in claim 5 wherein the linkage system further includes a first intermediate seat mounting link (50) having one end portion pivotally connected to the seat and an opposite end portion pivotally connected to the front seat mounting link (42) and having an intermediate portion pivotally connected to said opposite end portion of the pitch control link, and a second intermediate seat mounting link (52) pivotally interconnected to and between the seat and the rear seat mounting link (44).

9. The chair defined in claim 3 wherein there is included a stop (140) fixed to the main drive link (60) and engageable with the crank (57) when the chair is in the normal generally upright position.

10. The chair defined in claim 1 wherein there is included a stop (130) fixed relative to the seat and engageable with portions of the second bell crank (110) when the chair is in the opposite extreme positions thereof.

11. For use in a three-way wall-avoiding, recliner chair including a base, a seat and armrest unit including armrests fixed to the seat, a backrest mounted to and movable relative to the seat, a footrest including a footrest linkage mounted to the seat for movement between a retracted position adjacent the seat and an extended position projected forwardly from the seat, and a handle-operated, actuating mechanism mounted to the seat for actuating the footrest linkage between extended and retracted positions; a linkage system for mounting the seat and armrest unit to the base and for mounting the backrest to the seat and armrest unit for movement between a normal generally upright position and a plurality of reclining positions, the linkage system comprising, front and rear seat mounting links (42, 44) adapted to be pivoted to the base and pivotally connected relative to the seat, a first bell crank (107) pivotally connected to the rear seat mounting link, a drive link (104) having one end portion adapted to be pivotally connected to the backrest and an opposite end portion pivotally connected to said first bell crank link (107), a transmission link (63) adapted to be connected between the handle mechanism and the first bell crank for transmitting a force to the rear seat mounting link (44) to move the seat forwardly relative to the base into a TV position when the footrest is initially actuated to extended position by means of the handle mechanism, a restraining link (124) pivotally connected to and between the seat and the transmission link for preventing movement of the drive link and the backrest relative to the seat during movement of the seat into TV position, a second bell crank (110) having one end portion pivotally connected to the drive link at the same pivotal connection of the first bell crank to the drive link, said second bell crank having an intermediate portion adapted to be pivotally mounted to the seat such that the pivotal connection of the first bell crank to the transmission link is aligned with the pivotal connection of the second bell crank to the seat when the seat is in the TV position permitting the backrest to be moved relative to the seat and the seat to be reclined further relative to the base upon application of pressure on the backrest by the chair occupant causing a drive force to be transmitted downwardly from the backrest through the drive link (104) to the bell crank link, and a pitch control link (120) pivotally connected to an end portion of the second bell crank (110) opposite the first end portion thereof and adapted to be pivotally connected relative to the seat for transmitting actuating forces to the seat and for controlling the pitch of the seat when moving into reclining positions beyond TV position.

12. The linkage system defined in claim 11 further including a first intermediate seat mounting link (50) having one end portion adapted to be pivotally connected to the seat and an opposite end portion pivotally connected to the front seat mounting link (42) and having an intermediate portion pivotally connected to said opposite end portion of the pitch control link, and a second intermediate seat mounting link (52) adapted to be pivotally interconnected to and between the seat and the rear seat mounting link (44).

13. The linkage system defined in claim 11 further including a crank (57) adapted to be fixed to a handle included in the handle-operated actuating mechanism to be rotatable therewith, a main drive link (60) pivotally interconnected to and between the last-defined crank (57) and said transmission link (63) for driving the latter.

14. The linkage system defined in claim 13 wherein said transmission link (63) is also adapted to be pivotally connected to the footrest linkage to drive the same between the extended and retracted positions upon rotation of the handle.

15. The linkage system defined in claim 14 wherein said footrest linkage includes a mounting and drive link (67), and said transmission link is connected to said footrest mounting and drive link (67).

16. The linkage system defined in claim 15 wherein said footrest linkage further includes a pair of scissor links (66, 76), one (76) being adapted to be pivotally connected to the seat and the other (66), pivotally connected to said footrest mounting and drive link (67) and wherein there is further included a spring mechanism including a tension spring (72) having one end fixed relative to the scissor link that is connected to the footrest mounting link for biasing the footrest into retracted position.

17. The linkage system defined in claim 16 wherein the other end of the tension spring is fixed to the main drive link (60) such that in the retracted position of the footrest, the point of fixation of the spring to the associated scissor link is positioned rearwardly of the point of fixation of the spring to the main drive link 60, and in the extended position of the footrest the point of fixation of the spring to the associated scissor link is positioned forwardly of the point of fixation of the spring to the main drive link such that the spring also biases the footrest linkage to remain in the extended position.

18. The linkage system defined in claim 15 further including a first intermediate seat mounting link (50) having one end portion adapted to be pivotally connected to the seat and an opposite end portion pivotally connected to the front seat mounting link (42) and having an intermediate portion pivotally connected to said opposite end portion of the pitch control link, and a second intermediate seat mounting link (52) pivotally interconnected to and between the seat and the rear seat mounting link (44).

19. The linkage system defined in claim 13 wherein there is included a stop (140) fixed to the main drive link (60) and engageable with the crank (57) when the chair is in the normal generally upright position.

20. The linkage system defined in claim 11 wherein there is included a stop (140) fixed to the main drive link (60) and engageable with the crank (57) when the chair is in the normal generally upright position.

* * * * *